United States Patent [19]

Mueller

[11] Patent Number: 4,652,362

[45] Date of Patent: Mar. 24, 1987

[54] APPARATUS AND METHOD FOR SEPARATING HEAVY MATERIAL, MORE PARTICULARLY STONES OR THE LIKE, FROM CEREALS AND OTHER BULK MATERIALS

[76] Inventor: Roman Mueller, Büelhofstrasse 22, CH-9244 Niederuzwil, Switzerland

[21] Appl. No.: 817,730

[22] PCT Filed: May 8, 1985

[86] PCT No.: PCT/EP85/00209

§ 371 Date: Dec. 23, 1985

§ 102(e) Date: Dec. 23, 1985

[87] PCT Pub. No.: WO85/05050

PCT Pub. Date: Nov. 21, 1985

[30] Foreign Application Priority Data

May 8, 1984 [CH] Switzerland ..... 2240/84

[51] Int. Cl.[4] ..... B03B 4/00; B07B 9/02

[52] U.S. Cl. ..... 209/44.2; 209/312; 209/318; 209/466; 209/494

[58] Field of Search ..... 209/312, 315, 316, 318, 209/321, 466, 467, 481, 494, 44.2

[56] References Cited

U.S. PATENT DOCUMENTS

| | | | |
|---|---|---|---|
| 1,068,163 | 7/1913 | Payne | 209/466 |
| 4,319,990 | 3/1982 | Müller | 209/315 X |
| 4,466,542 | 8/1984 | Oetiker et al. | 209/467 X |

FOREIGN PATENT DOCUMENTS

| | | |
|---|---|---|
| 2104537 | 8/1972 | Fed. Rep. of Germany . |
| 547667 | 4/1974 | Switzerland . |
| 1545821 | 5/1979 | United Kingdom . |
| 1042817 | 9/1983 | U.S.S.R. . |

*Primary Examiner*—Andres Kashnikow
*Attorney, Agent, or Firm*—Darby & Darby

[57] ABSTRACT

In an apparatus for separating heavy material, more particularly stones, from cereals and other bulk goods, two superposed inclined vibrating tables (1, 2) are provided which have the same air flowing through them and a common drive (30), a product inlet (6) being provided at the top table (2). The bottom table (1) is constructed as a stone separating table and the top vibrating table is constructed throughout as a layering table and only its bottom end has a short zone (11) for the layer concentrated in heavy material to drop through and a discharge (19) to the bottom vibrating table (1). The discharge (19) is directed towards a central zone (B) of the bottom table (1). The material charged to the top vibrating table (2) via the product inlet (6) is layered thereon over its entire length and 20% to 80% of the flow of material containing the heavy material are withdrawn at its lower end and then discarded on to the middle zone (B) of the bottom table (1) in the form of a curtain to act as a material supply.

22 Claims, 5 Drawing Figures

A
B
C

APPARATUS AND METHOD FOR SEPARATING HEAVY MATERIAL, MORE PARTICULARLY STONES OR THE LIKE, FROM CEREALS AND OTHER BULK MATERIALS

TECHNICAL AREA

The invention relates to an apparatus and a method for separating heavy material, more particularly stones or the like, from cereals and other bulk goods, by means of two superposed inclined vibrating tables having the same air flowing through them and having a common drive, the bottom table being constructed as a stone separating table.

BASIC PRIOR ART

For cereal cleaning, all foreign constituents and dirt must be removed before the grain is ground. Cleaning is effected in a number of steps. Conventionally, large foreign bodies are removed by screening means, the mesh size in each case being so selected as to reliably recover all the grain material as passed material, while all particles larger than the rejected material are separated. Fine dirt and fine sand can be separated simultaneously by a correspondingly fine-perforation screen. In this way the actual grain is obtained with a foreign content consisting particularly of small stones, glass splinters and metal particles, and various light materials, such as large husk portions, broken pieces of stalk and foreign crops, all within a certain particle size spectrum, e.g. in the range from 2 to 6 mm in the case of wheat grades, or between 5 mm and 20 mm in the case of maize. Depending upon their external shape and size, the light constituents are separated by special separating tables (e.g. Paddy separators or light grain separators). Up to some 20 years ago a large proportion of the grain material pre-screened in this way to a given particle range and with the light constituents removed was taken through a water bath and the adhering dirt and stones washed out. Because of their greater weight, it was possible to collect the stones in this way at the bottom of the washing machine by the settling process.

The great advantage of this cleaning method which has been used on a wide scale for so long lies in its very good cleaning effect, but the disadvantage is the very large quantities of polluted washing water, which because of the risk of microbioloical contamination can be used only once and then has to also be cleaned.

DE-A-1 973 708 proposed a very considerable advance in connection with cleaning grain and the separation of stones. In this specification to separate heavy constituents grain material was charged on to a vibrating and ventilated separating table, the entire flow of material previously being taken through a vibrating pre-layering duct over a certain path. In the duct the stones accumulate in a bottom product layer through the vibratory movement of the duct and assisted by the air movement in the immediate vicinity of the bottom surface of the duct. The product flow thus pre-layered is then fed, without disturbing the layering, to the central zone of the separating table, where it is distributed across the entire table width. The layer thickness is thus immediately reduced and since the table is inclined downwardly somewhat in opposition to the incoming feed flow, the heavy parts (e.g. stones) again accumulate as a bottom layer in the zone adjacent the table surface, and on this bottom layer the lighter good particles flow downwardly to the grain material outlet under the effect of the air flow and the vibration, in the form of a layer on the bottom layer. The heavier particles in the bottom layer are fed to the top end of the vibrating table as a result of the projectile and vibratory movement of the bottom table, the said movement here being directed in exact opposition to the direction of flow of the good grains, i.e. in the direction of the higher end of this vibrating table. As a result all the heavy particles can be discharged through the stone outlet at the higher end of this table. The separating quantity is very good in this known apparatus and is not greatly impaired in practice even in the event of minor disturbances, e.g. fluctuations in air speed or the like, and instantaneous power fluctuations. Of course only the function of separating heavy constituents from a regularly much larger mass of other grain material is effected within the same apparatus, it not being possible to obtain an arbitrary increase in the throughput of the a machine in the upward direction. It has been found that after a given separating table surface size there is no longer any guarantee of perfect performance at each zone of the separating table, since accidental disturbances result in product accumulations and heavy particles may be entrained in the product flow.

Another known apparatus (DE-A-3 148 475) enables very high qualitative requirements to be met, it being possible not only to separate stones or the like but also divide particulate material into individual fractions (e.g. heavy and light fractions). Very good separation into heavy and light fractions and substantially complete stone separation are carried out in a single machine pass. To obtain these excellent results, however, it is necessary in the prior art apparatus for each individual working stage to be carried out under optimum conditions, but this means a considerable structural outlay (e.g. the use of a suction-extraction hood with divisions in the form of bulkheads, each intermediate space having an individually adjustable air throttle). The structural outlay (and hence the price) of this prior art apparatus is so high that there are very strict limits to the use of the apparatus. It has also been found with this apparatus that, as in the case of DE-C-1 913 708, only a limited increase of the product throughput is possible, since accurate guidance of the fluidized bed by control of the local quantities of air can no longer be effected satisfactorily in the case of excessive throughputs, so that it is impossible to obtain the required layering to the required degree.

An apparatus of the kind referred to hereinbefore is known from CH-A-587 687. This apparatus again uses two superposed vibrating tables having the same suction air flowing through them. The top table is constructed as a screening table and provided with three screens of different mesh widths, while the bottom vibrating table is only air-permeable but not product-permeable. Both tables are held in the inclined position by a common frame and are driven with a projectile and vibratory movement towards the higher table ends by means of an imbalance generator. The bulk material for sorting is introduced into the apparatus at the top end of the top table. Layering occurs as a result of the air flow and the projectile vibratory movement, during the flow of bulk material along the top vibrating table, so that the heavy constituents of the bulk material are concentrated in a bottom layer resting directly on the table. Depending on their size, the heavy particles finally fall through the corresponding perforations of the screen grid. The finest screen is disposed in the area of the inlet, so that the smallest particles of heavy material fall through first. This is followed by a screen with medium mesh and finally a coarse-mesh screen. Together with the stones a large proportion (80% to 97%) of the bulk material also falls on to the bottom table, the ratio of the load on the top vibrating table to that on the bottom vibrating table being controllable by setting different air flows and by suitable choice of throughput. The bottom vibrating table is constructed as a stone separator, so that in accordance with its projectile and vibratory movement all particles not lifted by the air are conveyed and delivered upwardly in the direction of the stone outlet. The light grain material on the other hand floats, as already described, like a liquid, borne by the air flow, above the layer having the heavy material concentration, and to the bottom product outlets.

It has been found in practice that this known apparatus does not give a very high degree of separation (percentage of separated stones) nor adequate separation resolution in dividing the material into a light fraction and a heavy fraction.

DISCLOSURE OF THE INVENTION

The object of the invention is to develop a stone separator of simple construction which operates very economically with excellent separating power and in which, in particular, the throughput is very high in comparison with the area of the vibrating tables.

According to the invention, in an apparatus of the kind referred to hereinbefore, this object is achieved by the fact that the top vibrating table is constructed throughout as a layering table and only at its bottom end does it have a short zone for the layer concentrated in heavy material to drop through and means for discharging the throughs to the bottom table, the discharge being directed towards a central zone of the bottom table.

The apparatus according to the invention in practice gives very excellent results as regards attainable separating resolution of the individual fractions, with a very good degree of separation and operates with a hitherto unknown cost-effectiveness. With the apparatus according to the invention it is possible, as compared with prior art apparatus with the same table area, to achieve a much increased throughput (or with distinctly reduced air expenditure for a predetermined screening capacity), giving a hitherto unknown cost-effectiveness in the use of this apparatus. In addition, the apparatus has a relatively simple uncomplicated structure which also allows cheap manufacture.

In previous solutions attention was in part devoted only to good separation procedure on the separating table itself. The product was discarded from a feed duct on to the table surface, the pouring point being chosen partly at the table end and partly at its central zone depending on the shape of the vibrating table. The flow of material introduced was discharged on to the vibrating table in the form in which it developed through the feed lines. The solution according to the invention, however, gets away from the handicap of wishing to optimize the individual functions. To obtain better separating resolution for the heavy additions, such as stones, and achieve a throughput increase beyond the conventional, according to the invention, the top vibrating table is used for the layer formation over its entire length and the layer concentrated with the heavy material is discarded on to a middle zone of the stone separator therebeneath only at its end within a short area which preferably is less than one-fifth of the length of the top table. The "middle zone" denotes an area which is in a central position with respect to the length of the bottom table, i.e., the two ends are each adjoined by another zone as far as the end of the table in question. Preferably, this middle zone of the bottom table covers the area which constitutes the area of the middle third of the bottom table, when the same has its length divided into three substantially equal zones. The steps according to the invention give very fortunate marginal conditions for favourable product flow. An important feature in this respect is the perfect formation of the layers on the top layering table, this being achieved by the fact that the top layering table is not product-permeable over a particularly large length, so that a good layer formation can build up unimpeded over this relatively considerable length of the top table. The resulting good layering also enables all the heavy material fraction concentrating in the bottom layer to be discharged over just a very short zone through which it drops at the end of this layer zone. This short zone for the material drop, i.e. the zone at the end of the top table, is preferably equal at maximum to one-fifth of the total length of the top table.

Experiments with the apparatus according to the invention have shown that this layer regularly contains 100% of stones artificially added during the test and the same are discharged at a substantially optimum point to the bottom vibrating table constructed as a stone separator. The separation work of the bottom table (stone separator) can thus be very considerably facilitated, since the lightest fraction no longer drops down and no longer interferes with separation on the stone separator.

In an advantageous development of the apparatus according to the invention, the discharge by way of which the material drops on to the bottom vibrating table from the short area of the drop zone is constructed in the form of a chute which terminates at a distance above the bottom table. The chute is very preferably inclined in the opposite direction to the inclination of the vibrating tables.

In another very advantageous construction of the apparatus according to the invention, the top end of the top table is ventilated and is covered by a sheet-metal guide cover disposed at a distance above the top table, the distance between the cover and the surface of the top table increasing towards the centre of the top table. As a result, the air fed through the vibrating table beneath the cover and flowing upwards can be deflected towards the middle of the top layering table (i.e. in the direction of the interior of the apparatus), this further assisting the layer formation. It has been found very effective if both tables are of the same width and the short zone for the product to fall through on the top table and the discharge each extend over the entire width of the tables.

In practice it has been found that the product flow occurring in the area of the top half of the bottom table appears to flow practically from the top point only in the direction of the grain material outlet disposed at the very bottom, although the introduction of the product via the discharge or chute takes place at a lower point, substantially at mid-height of the bottom table. The reason for this is that a very intensive layer formation occurs on the bottom table (stone separating table), the layer resting directly on the table being conveyed by the projectile vibratory movement of the table continuously up the table surface towards the stone outlet.

The fluidized bed or the bottom product layer travelling upwards on the table support is stopped in the region of the sheet-metal guide cover. The air sucked through the table surface in this area acts as an air jet against any further upward migration of the material. If the air speed is correctly adjusted, it is possible to achieve the effect that stones, glass splinters and metal parts can just migrate, as a result of the kinetic energy of the projectile vibration, as far as the top zone of the stone outlet.

Very favourable conditions are obtained if the distance between the bottom table and the top table is one-fifth to one-tenth of the length of the top table.

Preferably, the chute is constructed to be impermeable to air and terminates at subtantially mid-height between the bottom table and the top table. In order to prevent individual heavy particles from being entrained together with the tailings with the product flow possibly on the top table in the case of very high product throughputs, and prevent it from falling down, it is advantageous if a layer severing knife is disposed at the bottom end of the top table.

Preferably, the short zone for the product to fall through has passage apertures of a diameter equal to a multiple of the average particle size of the heavy material.

Optimum operation of the top table is also assisted if the same is finely perforated and has a smooth surface. Consequently, as a result of the projectile vibratory movement, a considerable inhibiting action is obtained for the product layer bearing directly on the top table, so that all the heavy parts, once they have entered the bottom layer, which is prevented from flowing off rapidly, cannot be returned to the top layer either by the air or by the vibratory movement. The effect of the formation of a top layer is particularly greatly promoted by this, so that both the required quantity of air and the vibratory energy can be utilized in the optimum manner. This again gives the advantage of maximum utilization of the vibrating table area in order to achieve a much greater throughput for a predetermined area.

It is also very advantageous in an apparatus according to the invention if the bottom vibrating table is provided with a material support which has an air-permeable fine mesh grid, and parallel and at a distance beneath the same a perforate plate and, between the two, a partition-like construction (sandwich construction) such that the bottom table has an air resistance which is substantially constant over the entire material support and independent of the thickness of the layer of material on it.

Preferably, the bottom vibrating table is also provided with a rough surface thus assisting the conveyance of the heavy particles by the projectile vibratory movement to the higher outlet for the heavy particles.

Advantageously, an outlet duct is disposed at the end of the top table for the tailings from that table, and leads into an aperture of the outlet for the tailings from the bottom table, while again preferably the top table outlet duct contains an adjustable flap for optional mixing of tailings from the top table and tailings from the bottom table and/or for separate discharge of both lots of tailings.

Very advantageously, the top table is air-permeable in the area of the product inlet, so that the layer formation in the area of the product inlet is promoted.

With the invention, the maximum surface propagation for the product is obtained on both the top and bottom table, but in such a manner that all the working area available receives product substantially uniformly and a substantially identical working cycle can be obtained at every point transversely of the direction of flow of the product. This working cycle is continued progressively and consistently from the beginning of the product entry to the associated vibrating table surface as far as the point where the corresponding working stage is completed. For the top table this means that the product is converted to a uniform layer from the beginning of the table over its entire width, and this layer formation is consistently developed as far as the bottom end of the same table. Only when the layer formation is completed, is the bottom layer with heavy particle concentration withdrawn, in the last short section of the top table, over a very short section, in the form of throughs from the top table. The product is also fed relatively uniformly over its entire width to a central zone of the bottom table in the form of a curtain, and from this zone a very uniform layer or fluidized bed forms again both in the direction of the higher end and in the direction of the lower end of the bottom table. Both the use of a fine-perforation plate and the sandwich construction of the bottom vibrating table promote this effect considerably, since as a result a substantially uniform air speed can be obtained at least on the bottom table surface, over the entire surface, and this is independent of the thickness of the instantaneous and local layer of material occurring there.

The apparatus according to the invention thus basically comprises two superposed inclined air-permeable vibrating tables, the bottom one of which can be given a projectile vibratory movement having a projectile component directed towards its top end, by means of an imbalance generator, both tables having the same air flow passing through them. The inlet for the material for treatment is situated at the top end of the top table, the latter having two zones over its length in the first one of which directly adjacent the inlet it is only air-permeable while the second zone adjoining this is additionally also product-permeable. The material falling through partially reaches the bottom vibrating table, which in turn has a heavy material outlet at its top end and a light material outlet at its bottom end. According to the invention, in comparison with the first zone which is only air-permeable, the second material-permeable zone of the top table is made very short and all the material falling through the second zone is completely fed to the middle zone of the bottom table, the top and bottom tables performing the same vibratory movement.

The invention also relates to a method of separating heavy material, more particularly stones, from a flow of material, e.g. cereals, by means of two vibrating tables which are inclined to product outlets, have the same air flowing through them, and are vibrated jointly, on both of which there is superimposed a projectile vibratory movement in the direction of whichever is the higher end of the associated table, the top table layering the material and the bottom table separating the heavy material, e.g. the stones or the like.

The method according to the invention is characterised in that the material on the top table is layered over its entire length and 20 to 80% (% by weight) of the flow of material containing practically all the heavy material is withdrawn from the lower end of the top table and is discarded on to a middle zone of the bottom table in the form of a curtain to act as the material supply.

The method according to the invention emphatically puts the stone separation function to the fore, but also allows a second function, i.e. light particle separation, all in a surprisingly simple and cost-effective manner. The method according to the invention ensures that there is discharged to the bottom stone separator table only and exactly that proportion of the total flow of material supplied which contains the heavy constituents, the light material fraction already being withdrawn at the top table and no longer being discharged downwards. Thus in the method according to the invention only a fraction of the total flow of material, i.e. 20 to 80% (by weight) is transferred to the bottom stone separating table, since the remaining fraction of the flow of material already discharged at the bottom end of the top table as the light particle fraction no longer contains any heavy particles. Thus the bottom table no longer has to process and handle the entire product throughput, but only the corresponding throughput fed to it, thus greatly relieving the load on the stone separating table. This would be impossible however, if a screening operation were carried out at the same time as the layer formation on the top table, as is the case, for example, with CH-A-587 687.

A layer formation again takes place on the bottom vibrating table but this is carried out only with the smaller proportion of the original flow of material, i.e. the one discarded downwardly. Since a flow of product with a relatively large proportion of heavy constituents is discarded on to the bottom table, the relatively light particles are there already very quickly converted into a layer forming above the heavy particles and floating as far as the bottom end of the bottom table, and hence relatively quickly fed to the grain material outlet.

It has been found that very favourable results are obtained if (preferably) 30 to 60% (by weight) of the total flow of material fed to the top table are transferred together with the heavy material to the middle zone of the bottom table. In many cases, however, the attempt is made for less than 50% of the total flow of material fed to the top table to be discarded on to the bottom table (stone separating) table).

Advantageously, the material forming in the form of a curtain from the top table on to the bottom table has a powerful flow of air blown through it, so that the falling curtain of material can be loosened somewhat, this again promoting the layer formation on the bottom table.

Preferably, an air jet directed towards the other end of the bottom table is produced at the top end thereof immediately above the surface thereof in order to limit the fluidized bed of material forming on the bottom table.

Preferably, the supply of material to the bottom table is deflected by a chute into a direction opposed to the direction of flow of material on the top table and thus discarded on to the bottom table. Here too, additional loosening of the material is achieved. Advantageously, air is taken continuously through the two tables and is deflected in the area of the chute in to a direction opposed to the material movement occurring there.

In the method according to the invention the cereal is fed at the top end of an inclined first table through which air flows, is taken along the table over a flow zone, layering being effected into a top light layer and beneath it a layer having a heavy material concentration. The layer having the heavy material concentration is then discarded from the first vibrating table and partially fed to a second inclined vibrating table through which air flows, where it is converted into a fluidized bed, and from which the heavy material or the remaining fraction which the heavy material has been removed is withdrawn at both ends of the second vibrating table. In these conditions according to the invention, all the layer having the heavy material concentration is withdrawn at the end of the flow path along just a short drop zone and completely discarded on to a middle zone of the second vibrating table.

The method according to the invention has proved very satisfactory in practice and given surprising performance and achieved a remarkable separating quality even in the case of materials which are difficult to separate.

SHORT DESCRIPTION OF THE DRAWINGS

The principle of the invention will be explained in detail hereinafter by way of example with reference to the drawing wherein.

DETAILED DESCRIPTION OF DRAWINGS

Figure 1:
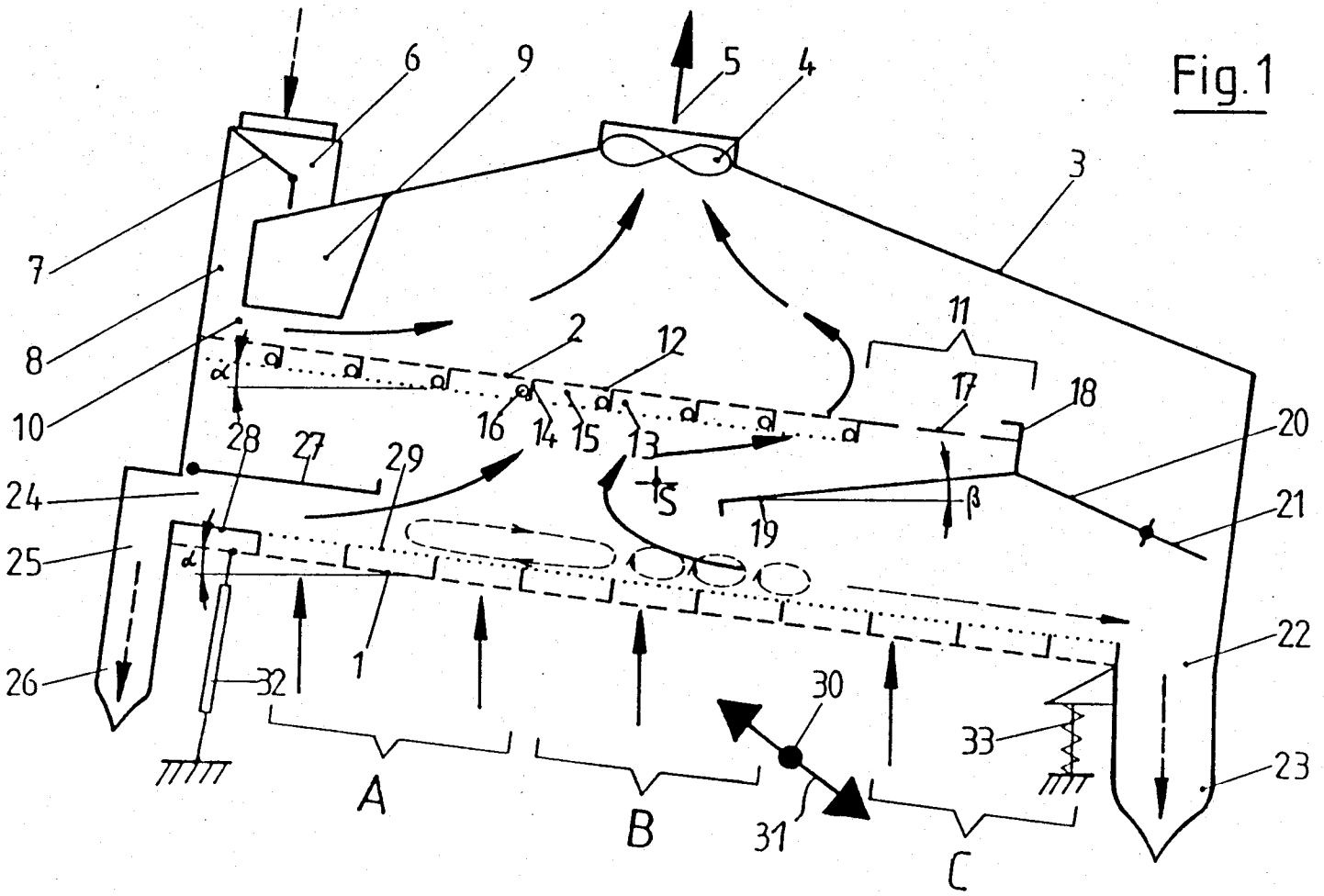
FIG. 1 is a diagrammatic longitudinal section through an apparatus according to the invention.

The apparatus illustrated in FIG. 1 comprises a bottom vibrating table 1 constructed as a stone separating table, a top vibrating table 2 constructed as a layering table and a housing 3 which encloses the two tables at the sides and the top. The stone separating table 1 is open at the bottom; the air drawn in freely from the surroundings through the table 1 is drawn off through the table 2 by a fan 4 shown only symbolically in FIG. 1, in the direction of the arrow 5 for cleaning. In the embodiments shown in FIGS. 1 and 2, the product for treatment is introduced at the top left via a product inlet 6 and a transition 8 directly to the top table 2, a sheet-metal guide cover 9 being disposed directly after the product inlet 6 and at a distance above the top table 2, said cover co-operating with the top table 2 to form a feed duct 10, the cross-section of which increases in the direction of the middle of the top table 2. Table 2 has a smooth fine-perforation plane plate 12 except for a short zone 11 at its bottom end intended for the product to fall through, a grid 13 being provided beneath the plate 12 and being fixed to spacer surfaces 14. Partition-like portions or compartments 15 are formed between the plate 12 and the grid 13 and extend transversely of the longitudinal direction of the top table 2. A ball 16 is provided in each compartment 15 to keep clean the fine perforations in the plate 12. The short zone 11 for the product to fall through has a large number of apertures 17 distributed uniformly over its entire surface. A layer severing knife 18 is also disposed at the bottom end of the top table 2 and is situated at a distance corresponding approximately to the thickness of one finger from the surface of the table and assists in the distinct guidance of the two incoming layers (the bottom layer having a concentration of heavy material with the light material fraction above it). A chute 19 is disposed below the short zone 11 for the product to fall through, which extends over not more than 20% of the total length of the top table 2, and extends from the end of the top table 2 towards a middle zone of the bottom table 1 in an inclination extending in the opposite direction to the inclination of the tables 1 and 2, the chute end being situated at about half the height of the distance between the two tables 1 and 2. The stone separating table 1 and the layering table 2 are substantially parallel to one another and disposed at an angle $\alpha$ to the horizontal in a corresponding common inclined position. The chute 19, on the other hand, has an angle $\beta$ to the horizontal such that in all the imaginable inclined positions of the two tables 1 and 2 the chute 19 still has at least a slight inclination to the horizontal.

The bottom vibrating table 1 (stone separating table) can be divided up into three substantially equal sections A, B and C. Since the product is always "in flux" on a continuously operating fluidized bed table of the kind represented by the bottom table 1, it is of course difficult to assume local limits for certain functions if they are not effected by fixed walls or additional forces. Consequently, it is therefore only as an attempt at explanation that it is assumed that there is mainly a layer flow in the section A on the bottom table 1, a classic fluidized bed in the middle section B ("middle zone" of the bottom vibrating table 1) and an outflow in the section C.

In order to ensure that all the air flowing through the stone separating table 1 also flows through the vibrating table 2, a partition 20 and an adjustment flap 21 are provided at the bottom end of the top table 2 so that any secondary air occurring can be kept very small. To avoid any disturbing secondary air entering from outside, all the outlets are provided with a closure after the style of a lock.

The bottom vibrating table 1 (stone separating table) has an outlet 22 for the cleaned material with a product lock 23 and with a stone end separating zone 24, a stone discharge duct 25, and a stone lock 26. Both the product lock 23 and the stone lock 26 are made from elastomeric material, as known per se, and open as soon as there is sufficient product in the outlets 22 and 25. Without any product, on the other hand, the locks 26 and 23 are closed.

The stone end separating zone 24 is formed at the top by a guide plate 27 and at the bottom by a closed bottom portion 28 and a ventilated bottom portion 29, which extend over the entire width of the table surface.

The entire apparatus is vibrated in the direction of arrows 31 by a vibratory drive 30, the direction of vibration extending basically through the centre of gravity S (cf. FIG. 1) and being directed at an angle of between 20° and 40° to the length of the two vibratory tables 1 and 2 generally in the direction from the outlet 22 to the feed duct 10. The apparatus is also resiliently suspended by a vertically adjustable articulated strut 32 and, in the zone of the outlet 22, by a spring strut 33. The linear vibratory movement in the direction of the arrows 31 and the corresponding support system provided by the struts 32 and 33 give the two vibratory tables 1 and 2 a combined projectile and vibratory movement with a superimposed feed component directed in the upward direction of the table.

Figure 2:
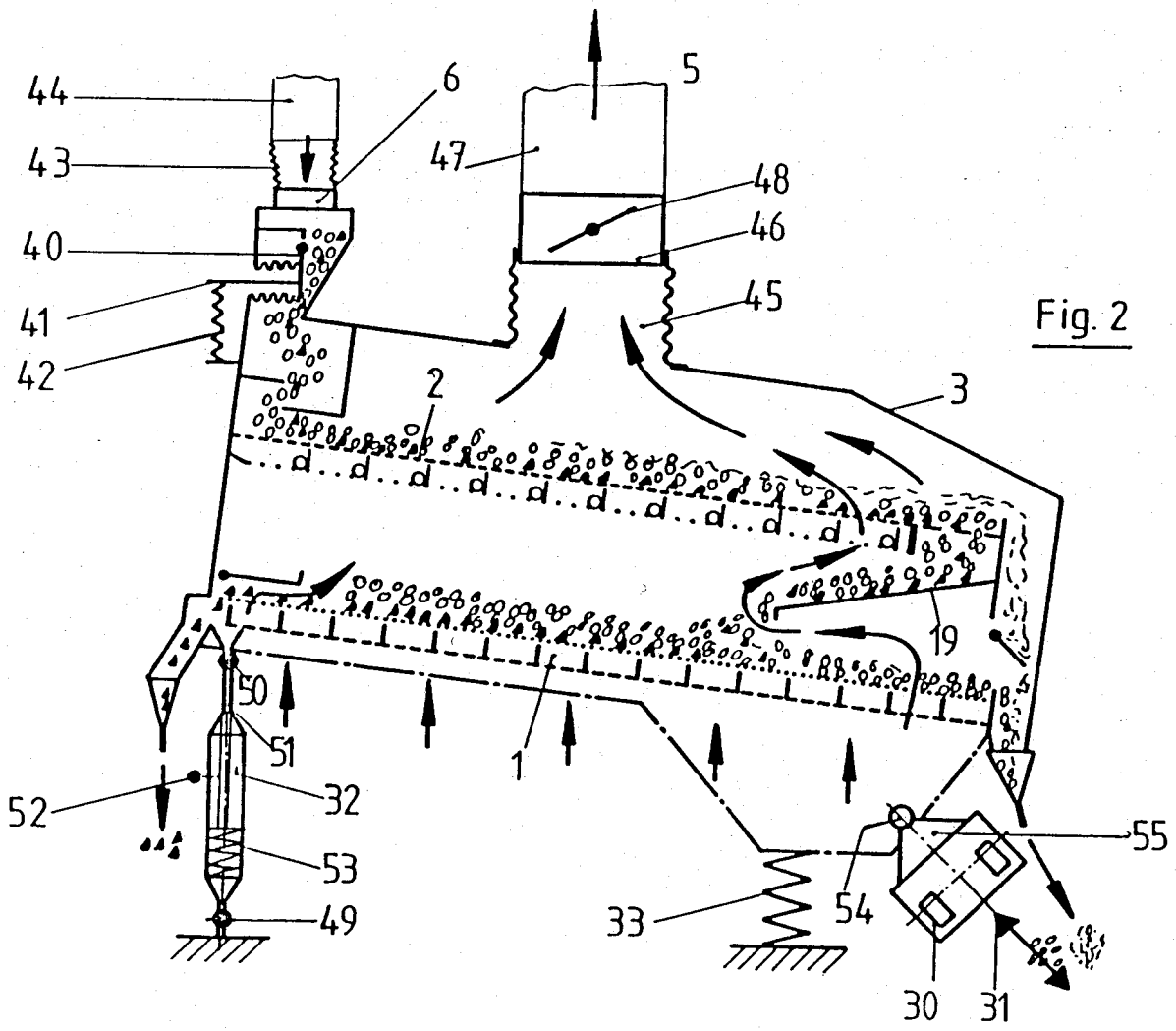
FIG. 2 shows the apparatus according to the invention already shown in principle in FIG. 1 with additional constructional details, also in a diagrammatic form.

In the illustration shown in FIG. 2, the apparatus has a product control flap 40 at the product inlet 6, said flap being so adjustable by means of a lever 41 and a spring 42 that the passage is open when a certain amount of product is present but closed in the absence of a sufficient amount of product. Thus any undesirable entry of air can be prevented at this place.

The product inlet 6 is connected via a flexible bellows 43 to a product feed pipe 44 which forms part of the fixed installation of the complete apparatus. The bellows 43 enables the apparatus to perform the relative movement required for a vibratory movement. A similar construction is logically also provided at the air suction extractor 5 where a large bellows 45 separates the vibrating apparatus from a fixed spigot 46 fixed to a suction line 47. Spigot 46 contains an air adjustment flap 48 by means of which the total quantity of air can be controlled.

The strut 32 is held both at the bottom and the top by a bearing 49 and 50 respectively which allows rotary movements. The length of the strut 32 can be adjusted by a screwthreaded rod 51 and a rotary lever 52, so that the two tables 1 and 2 can be brought into the optimum inclined position at any time by this means. A compression spring 53 can also be incorporated in the strut 32 to facilitate the deflection of the top table ends.

The vibrating drive 30 is not rigidly connected to a cross-member 54, but on the contrary so connected thereto via a special joint 55 that in actual fact only a linear force component is transmitted in the direction of arrow 31 to the complete apparatus and the described projectile and vibratory movement is superimposed on the tables 1 and 2 by the special mounting.

Also of interest is the air guidance around the chute 19 in a direction extending basically in opposition to the movement of the product, as shown clearly by arrows particularly in FIG. 2.

Figure 4:
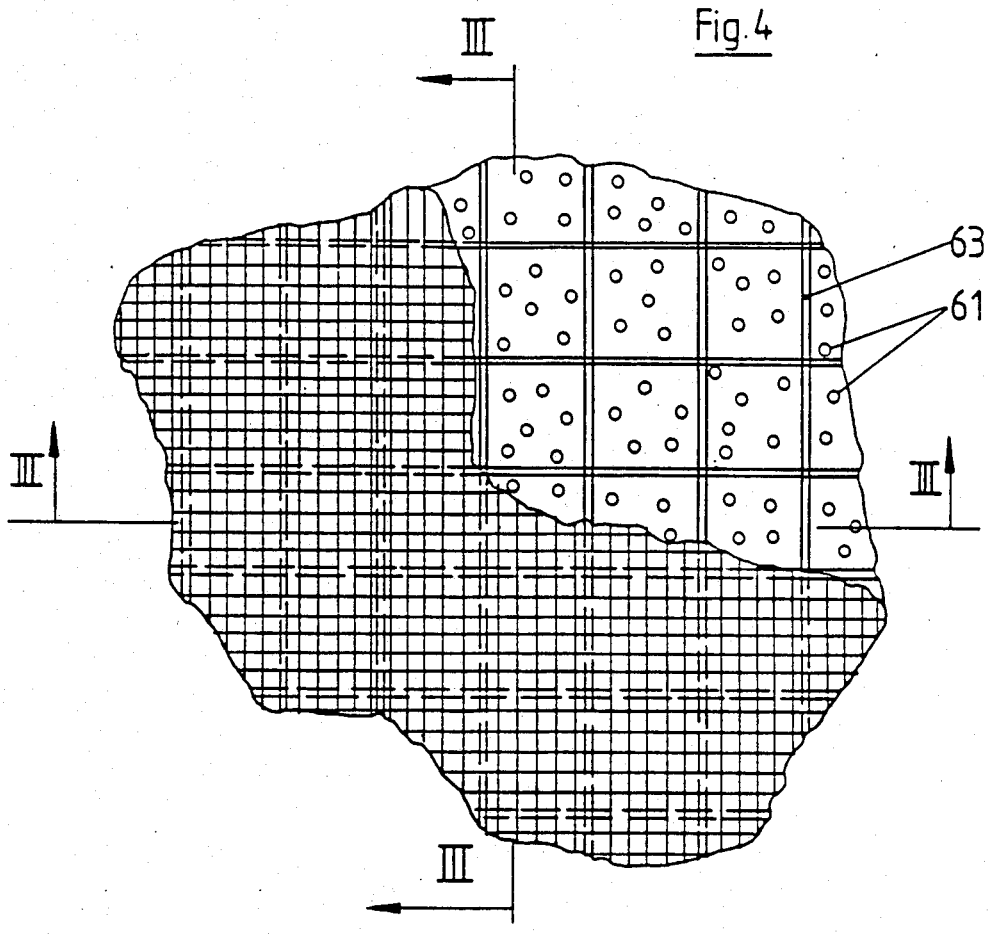
FIG. 4 is a plan view of a detail (in partial section) from FIG. 3.
Figure 3:
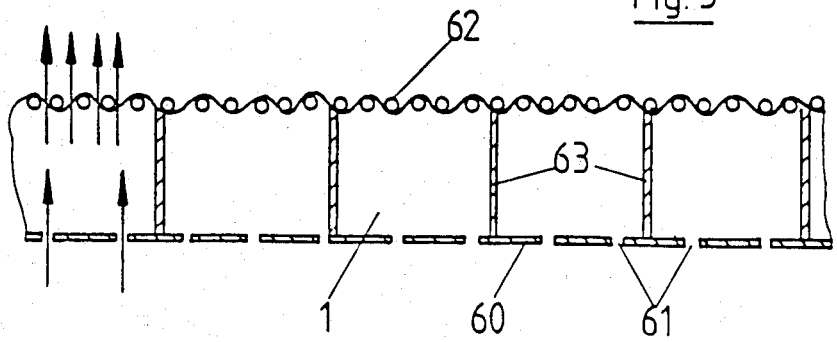
FIG. 3 is a section through the sandwich construction of the bottom vibrating table (stone separating table) in the apparatus of the invention shown in FIGS. 1 and 2.

FIGS. 3 and 4 now show the special floor construction (sandwich construction), FIG. 3 showing both the cross-section III—III shown in its position in FIG. 4 and the longitudinal section III—III.

The sandwich construction shown in FIG. 3 for the bottom vibrating table 1 (stone separating table) comprises a perforate plate 60 at the bottom with very fine perforations 61, and a rough mesh grid 62 at the top, being separated from the plate 60 by partitions 63 extending transversely of the longitudinal direction of the floor. As will be apparent from FIG. 4, the partitions 63 provide a compartmentalization between the perforate plate 60 and the grid 62 so that the air is obstructed from performing transverse movements between the perforate plate 60 and the grid 62. Plate 60, grid 62 and partitions 63 together give the sandwich construction. The result is a construction by means of which the overall structure of the bottom vibrating table 1 represents a substantially equal resistance over the entire area of the bottom vibrating table, to the through-flowing air, said resistance being substantially independent of the thickness of the layer of material resting on the bottom vibrating table 1. This resistance effect can be further enhanced by appropriate choice of perforation of the plate 12 of the top table 2. A substantially constant air resistance can be obtained over the entire bottom material support, independently of the local and instantaneous thickness of the layer of material on the bottom table 1, and this effect is obtained by the sandwich construction of the bottom table alone, but also in addition by suitable selection of the perforation in the finely perforated plate 12 of the top table 2. Preferably, the sum of the cross-sections of the perforations of the fine-perforation plate 12 is less than or (at maximum) equal to one-tenth of the total area, but is at the same time more than twice the total area of the passage cross-sections of the material support constructed in the form of a grid 62. Another important factor in this connection is that the perforations in the plate 12 are distributed uniformly over the surface of the fluidized bed table and the distribution of the holes and their spacing from the material support in the form of the grid 62 are so selected that the air flowing through the perforations impinges on the material support 62 with a substantially uniform dynamic pressure. The best results have been obtained with a total perforation cross-section in the plate 12 of about 3 to 8% of the total area of the material support 62.

Figure 5:
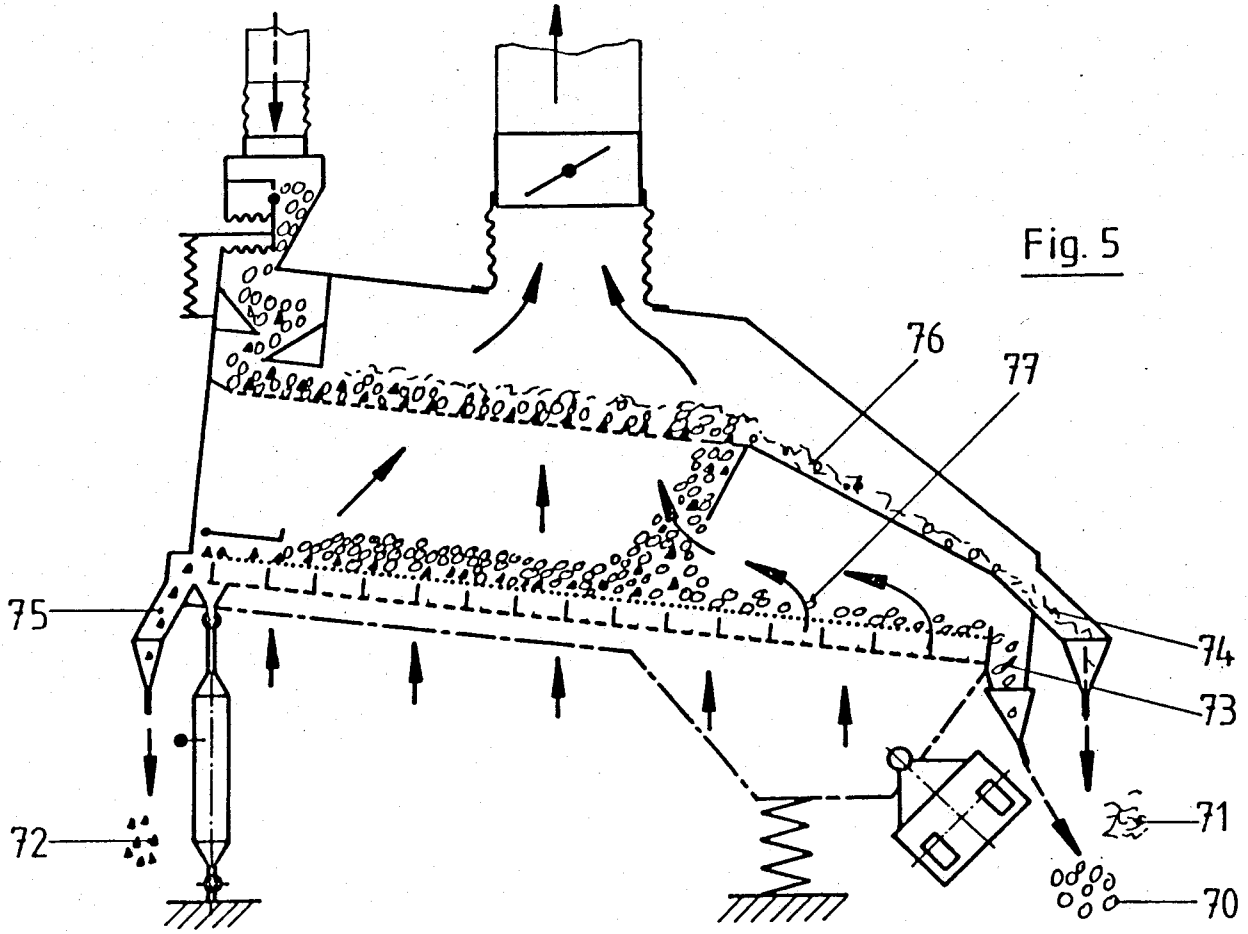
FIG. 5 illustrates a different embodiment of an apparatus according to the invention from that shown in FIG. 2.

The main difference between the solutions shown in FIGS. 2 and 5 is that in the apparatus in FIG. 2 only the stones or the heaviest parts are separated from the total product flow while in the apparatus according to FIG. 5 there is also a separation into a heavy particle fraction 70 and a fraction 71 of the lightest parts and the stone fraction 72. The apparatus shown in FIG. 5 comprises a grain outlet 73, a light material outlet 74 and a stone outlet 75, each outlet again being provided with a corresponding product lock to prevent any entry of secondary air. The embodiment of an apparatus according to the invention as shown in FIG. 5 can be used in all cases in which the requirements in respect of the quality of separation into the grain fraction and the light fraction are not excessively strict. In certain limits, the ratio of the top light material flow 76 to the bottom grain flow 77 can be influenced by changing the inclination of the vibrating tables 1 and 2 and the amount of air flowing through.

Although the apparatus according to the invention is suitable particularly for stone separation from cereals, it is expected that the apparatus according to the invention and the method according to the invention can also be used for similar purposes for other bulk goods having similar properties.

I claim:

1. An apparatus for separating heavy material, more particularly stones or the like, from cereals and other bulk goods, the device having two vertically superposed inclined vibrating tables positioned in the same air flow stream, a common drive for said tables, the top table being provided with a product inlet and the bottom table being constructed as a stone separating table, characterized in that the top vibrating table is constructed throughout as a layering table having near its lower end a short zone for the layer concentrated in heavy material to drop through and means for guiding discharge from said zone to the bottom table, the discharge guide means being directed towards a middle zone of the bottom table.

2. Apparatus according to claim 1, characterised in that the discharge guide means is constructed in the form of a chute which terminates at a distance above the bottom table.

3. Apparatus according to claim 1, characterised in that the middle zone of the bottom table on to which the chute of the top table is directed covers the zone of the middle third of the bottom table in a predefined longitudinal direction.

4. Apparatus according to claim 2, characterised in that the chute is inclined in the opposite direction to the inclination of the tables.

5. Apparatus according to claim 1, characterised in that the short zone for the product to fall through on the top table is at most one-fifth of the total length of the top table.

6. Apparatus according to claim 1, characterised in that the higher end of the top table is ventilated and is covered by a sheet-metal guide cover disposed at a distance above the top table, the distance between the cover and the surface of the top table increasing towards the centre of the top table.

7. Apparatus according to claim 1, characterised in that both tables are of the same width and the short zone for the product to fall through on the top table and the discharge guide means each extend across the entire width of the tables.

8. Apparatus according to claim 1, characterised in that the distance between the bottom table and the top table is one-fifth to one-tenth of the length of the top table.

9. Apparatus according to claim 2, characterised in that the chute is constructed to be impermeable to air and terminates at substantially mid-height between the bottom table and the top table.

10. Apparatus according to claim 1, characterised in that a layer severing knife is disposed at the bottom end of the top table.

11. Apparatus according to claim 1, characterised in that the short zone for the product to fall through has passage apertures of a diameter equal to a multiple of the average particle size of the heavy materials.

12. Apparatus according to claim 1, characterised in that the top table constructed as a vibratory table has a fine perforation and a smooth surface.

13. Apparatus according to claim 1, characterised in that the bottom vibrating table is provided with a material support which has an air-permeable fine mesh grid, and parallel and at a distance beneath the same a perforate plate and, between the two, a partition-like construction such that the bottom table has an air resistance which is substantially constant over the entire material support and independent of the thickness of the layer of material on it.

14. Apparatus according to claim 1, characterised in that an outlet duct is disposed at the end of the top table for the tailings from the table, and leads into an aperture of an outlet for the tailings from the bottom of table.

15. Apparatus according to claim 14, characterised in that the outlet duct contains an adjustable flap for optional mixing of tailings from the top table and tailings from the bottom table and/or for separate discharge of both lots of tailings.

16. Apparatus according to claim 14, characterized in that the outlet duct contains an adjustable flap for separate discharge of tailings from the top table and tailings from the bottom table.

17. Apparatus according to claim 1, characterised in that the top table is air-permeable in the area of the product inlet.

18. A method of separating heavy material, more particularly stones, from a flow of material, e.g. cereals, by means of two vibrating tables having a common air flow stream there through, which tables are inclined to product outlets, and are vibrated jointly, on both of which there is superimposed a projectile vibratory movement in the direction of whichever is the higher end of the associated table, the top table layering the material and the bottom table separating the heavy material, the method comprising layering the material on the top table over its entire length, withdrawing 20% to 80% of the flow of material containing the heavy material from the lower end of the top table and discarding the same onto a middle zone of the bottom table in the form of a curtain to act as the material supply.

19. A method according to claim 18, further comprising blowing a powerful flow of air through the material falling in the form of a curtain from the top table onto the bottom table.

20. A method according to claim 18, wherein an air jet directed towards the other end of the bottom table is produced at the top end thereof immediately above the surface thereof in order to limit the fluidized bed of material present there on the bottom table.

21. A method according to claim 18, wherein the supply of material to the bottom table is deflected by a chute into a direction opposed to the direction of flow of material on the top table and is discarded onto the bottom table.

22. A method according to claim 21, wherein air is taken continuously through the two tables and is deflected in the area of the chute in to a direction opposed to the material movement occurring there.

* * * * *